United States Patent [19]

Larsson

[11] 3,991,501

[45] Nov. 16, 1976

[54] LOADING MAGAZINE

[75] Inventor: Sven Gunnar Olof Larsson, Huskvarna, Sweden

[73] Assignee: Gunnebo Bruks AB, Gunnebobruk, Sweden

[22] Filed: Jan. 29, 1975

[21] Appl. No.: 545,212

[52] U.S. Cl. ..... 42/88; 224/18

[51] Int. Cl.[2] ..... F42B 39/06

[58] Field of Search ..... 42/87–89, 42/6, 49 R; 124/48–50; 224/18; 227/9–11

[56] References Cited

UNITED STATES PATENTS

| | | | |
|---|---|---|---|
| 619,848 | 2/1899 | Sparrow | 42/87 |
| 1,038,355 | 9/1912 | Hamilton | 224/18 |
| 1,734,852 | 11/1929 | Frampton et al. | 42/87 |
| 2,508,820 | 5/1950 | Fraley | 42/88 |
| 2,573,003 | 10/1951 | Fraley | 224/18 |
| 3,757,449 | 9/1973 | Schindler | 42/87 |
| 3,808,723 | 5/1974 | Erixon | 42/87 |

*Primary Examiner*—Charles T. Jordan
*Attorney, Agent, or Firm*—Holman & Stern

[57] ABSTRACT

A drum-shaped loading magazine for cartridges, tablets and the like is disclosed. The loading magazine includes a plurality of parallel channels and a device for completely emptying the magazine by means of successive advancing of the channel openings toward a loading position, in which position a load is ejected as long as one of the channels still contains a further load. The openings of the channels are at least partially closed by means of a stop member in the magazine, whereby at least one part of the stop member for a channel can be opened and closed during the rest position.

2 Claims, 4 Drawing Figures

LOADING MAGAZINE

BACKGROUND AND SUMMARY OF THE INVENTION

The present invention is concerned with a magazine for loadings in the form of cartridges, tablets, bullets and the like, which includes a device for inserting loads at the rate of one at a time until the magazine has been completely emptied.

The present invention represents an improved magazine which contains a plurality of parallel channels, and a device for completely emptying the magazine by means of successive advancing of the channel openings toward a loading position, in which position a load is ejected as long as one of the channels still contains a further load. The magazine and the emptying device are preferably separably arranged so that an empty magazine can be simply exchanged with a filled magazine.

A substantial advantage of the present invention lies in the fact that the magazine can only be emptied when it is inserted in the device, which will thereby prevent loads from being lost when the magazine is removed from the device. Furthermore, the device has the advantage that one simple loading movement of the same as well as the emitting of a load covers the changing of channels to the loading position between successive loading movements. The present magazine should be so constructed that the openings of the channels are at least partially closed by means of a stop member in the drum-shaped magazine, whereby at least one part of the stop member for a channel can be opened and closed during the rest position.

BRIEF DESCRIPTION OF THE DRAWINGS

One embodiment of such a loading magazine, together with a device for the emitting of loads, will now be described in more detail, with reference to the accompanying drawings wherein.

DESCRIPTION OF THE PREFERRED EMBODIMENTS

The basic magazine employed in the present invention is of the type which is illustrated and disclosed in German Disclosure Publication No. 2,314,893. This prior art magazine includes a drum which is positioned in a bracket, with the bracket being arranged in a holder at one side of a power tool. The bracket is inclinably positioned on the holder and, when in a downward folded position, reaches into the loading opening, but it is generally retained in an upward position by means of a helical spring. In the forward section of the bracket, there is provided a hole into which each channel can be connected simply by turning the drum. The load in one of the channels connected to the hole can thereby fall forward against the inner end of the firing barrel of the tool when the magazine is retained in a downward-folded position. Such a type of magazine, with which the present invention is concerned, is known in the prior art.

Figure 1:
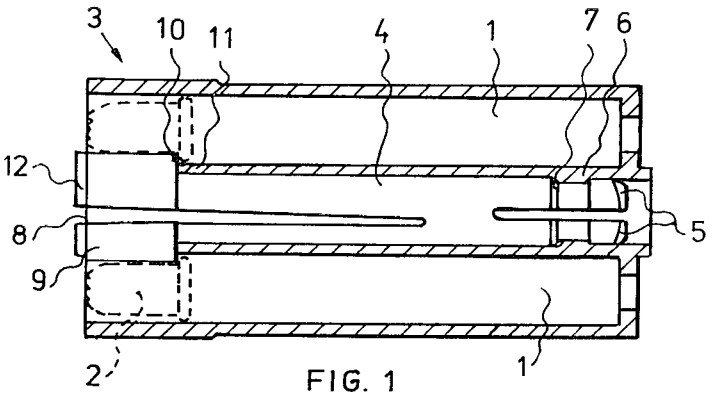
FIG. 1 shows a longitudinal cross-section of the magazine of the present invention.

The magazine of the present invention as shown in FIG. 1 is of a similar structure as the above-described prior art magazine and has a plurality of axially arranged channels 1, which channels are provided with space for the loads 2, the loads being shown in the form of cartridges. The drum 3 has an axle 4, around which axle 4 said drum 3 can be rotated. The axle 4 is provided at one end with a pair of resilient locking-members 5 which snap in behind a reduced portion 6 in the central axial bore 7, when the axle is guided into this hole from the left, as seen in FIG. 1. The other end is provided with a slot 8 which divides this section of the axle, so that a tongue 9 is formed. Furthermore, the axle is provided with a holder ring 10, which partially abuts in one end of the drum against a recess 11, and partially protrudes into the channels 1.

The outer end of the axle 4 is formed as a wedge 12 with its tip pointing downwardly, as shown in FIG. 1. As can be seen from this figure, the holder ring 10 prevents the loadings from falling from the magazine. That part of the holder ring 10 which is located adjacent to the tongue 9, however, glides out of the channel when the tongue 9 is lifted, and the path of the load or charge in this channel is then free so that it can be emitted.

Figure 2:
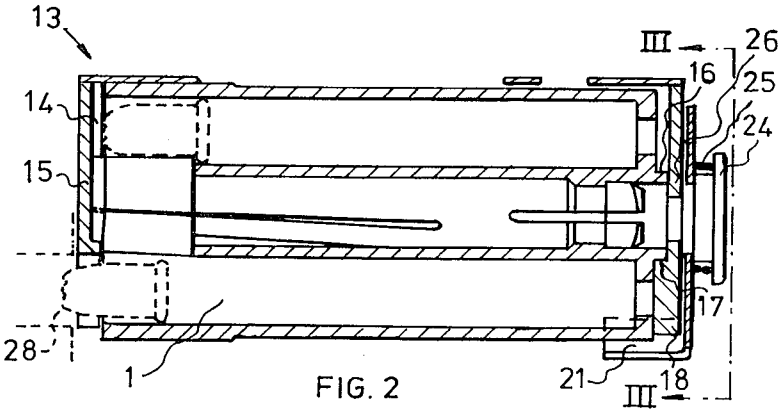
FIG. 2 shows a longitudinal cross-section of the magazine in accordance with FIG. 1 inserted in a device for delivering loads.
Figure 3:
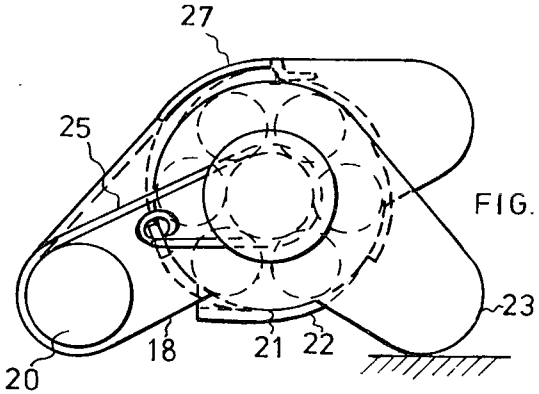
FIG. 3 shows the magazine and device according to FIG. 2 in a rest position as seen in the direction of the arrow III—III.
Figure 4:
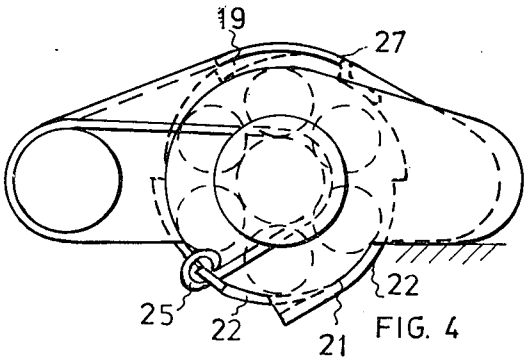
FIG. 4 shows the same view as in FIG. 3, but with the device in an activated or loading position.

The magazine according to FIG. 1 is proposed to be utilized in a device according to FIGS. 2 through 4. The device of FIGS. 2 through 4 is constructed as a supported or positioned cartridge or shell 13 which is open towards one side, into which the magazine is insertable in only one manner namely, in a manner so that the wedge 12 is retained in a key track 14 in one end-section 15 of the cartridge or shell. The tip of the wedge 12 strikes the bottom of the track 14 and is pushed against the center of the axle so that the lower section of the holder ring 10 glides out of the lowermost positioned channel 1. In this position, the drum is rotatable around the axle 4, which is retained securely by means of the wedge as well as in a holder ring 16 and a bearing seat 17 which corresponds with the same, at the rear end of the drum.

The device is provided with a cockable bracket 18 which, in a closed position as illustrated, covers the opening 19 of the cartridge or shell, so that the magazine in the center of the cartridge is held back during its rotation. This rotation is initiated during a loading movement whereby the device is tilted by an axle 20, which axle 20 is mounted on a support, with the result that a locking catch 21, which is in engagement with a tooth 22 and provided with a lever 23, is positioned on a protruding screw 24 in the rear section of the device, and simultaneously with the loading movement is tilted around the center axis of the cartridge by an angle which corresponds with the distance between two channels 1 of the magazine.

The number of teeth 22 of the magazine is identical to the number of channels 1 in the magazine, and in the illustrated embodiment there are six pieces. The tilting of the locking catch 21 is effected in that the lever 23 rests against the base support, as shown in FIG. 3, and performs an angular movement in a counterclockwise direction (see FIG. 4) when the device swings about an axle 20. The return of the locking catch 21 is produced by means of a helical spring 25 with contact points on the blocking means and the axle 20, whereby the blocking member, due to the location and size of the hole 26, passes or skips over the next-following tooth 22 in the hole, and is able to stop behind the same. The magazine is retained in its new position by means of a flange blocking means 27 which is formed in the bracket 18.

By means of the present device, it is possible to empty a selective number of loads which are located in the lowermost channel. The number is preferably determined by the unit 28 which has been received, which unit may be a cartridge load, whereby only one load is emitted each time. After each loading movement, the load moves from the momentarily lowermost situated channel of the magazine, which is true successively for all channels and which means that the magazine is automatically completely emptied.

The illustrated magazine should serve as an example of an embodiment of the present invention. The magazine is partially an auxiliary means during the emitting of loads, and partially a protection for the same during transport and storage. Thus the loads, being of a nature which in open condition may cause damage, are retained in a sufficiently closed condition. It should be noted that the bolting or blocking in front of the channel openings, as illustrated, may be constructed in a different form, without deviating from the basic concept of the present invention, as defined in the appended claims.

What is claimed is:

1. A loading magazine in the form of a drum, comprising a plurality of parallel channels with openings provided at an end section of the drum, loadings adapted to be placed in rows in said channels, the openings of the channels being at least partially closed by means of a stop member which is rotatably positioned in the drum, and so positioned that at least a portion of the stop member in itself can be opened for a channel and by rotation movable from one channel opening to another channel opening, but closed when in a rest position; said magazine being rotatably positioned in a device provided with a holder to keep the stop member in a fixed position and when placing the drum into said device to force that portion which is to be opened into its open position.

2. The loading magazine of claim 1, wherein the magazine is provided with a row of teeth into which engages an advance member which rotates the drum in a gradual manner to a partial distance between two successive channels, dependent upon an accomplished loading movement of the magazine.

* * * * *